US008555685B2

(12) United States Patent
Frolov et al.

(10) Patent No.: US 8,555,685 B2
(45) Date of Patent: Oct. 15, 2013

(54) ELECTRICALLY CONTROLLED DOOR LOCK

(76) Inventors: George Frolov, Farmington, CA (US); James Scott, New Britain, CT (US)

( * ) Notice: Subject to any disclaimer, the term of this patent is extended or adjusted under 35 U.S.C. 154(b) by 283 days.

(21) Appl. No.: 12/897,729

(22) Filed: Oct. 4, 2010

(65) Prior Publication Data

US 2011/0079057 A1 Apr. 7, 2011

Related U.S. Application Data

(60) Provisional application No. 61/248,563, filed on Oct. 5, 2009.

(51) Int. Cl.

| | |
|---|---|
| ***E05B 47/06*** | (2006.01) |
| ***E05B 47/00*** | (2006.01) |
| ***E05B 49/00*** | (2006.01) |
| ***E05B 55/04*** | (2006.01) |
| ***E05C 1/02*** | (2006.01) |
| ***E05C 1/06*** | (2006.01) |
| ***E05C 3/04*** | (2006.01) |

(52) U.S. Cl.
USPC ..... 70/283; 70/277; 70/278.7; 70/477; 70/481; 70/482; 292/137; 292/138; 292/207

(58) Field of Classification Search
USPC ..... 70/277, 278.7, 279.1, 283, 283.1, 481, 70/482, 472–475, 477; 292/137, 138, 145, 292/150, 144, 202, 207
See application file for complete search history.

(56) References Cited

U.S. PATENT DOCUMENTS

| | | | | |
|---|---|---|---|---|
| 3,800,573 | A * | 4/1974 | Babb et al. | 70/217 |
| 4,800,741 | A * | 1/1989 | Kerschenbaum et al. | 70/13 |
| 5,715,715 | A * | 2/1998 | Nunez | 70/283 |
| 5,992,195 | A * | 11/1999 | Huang et al. | 70/472 |
| 6,062,612 | A * | 5/2000 | Lin | 292/144 |
| 6,076,870 | A * | 6/2000 | Frolov | 292/341.16 |
| 6,178,794 | B1 * | 1/2001 | Eller et al. | 70/472 |
| 6,487,884 | B1 * | 12/2002 | Constantinou | 70/277 |
| 6,851,291 | B2 * | 2/2005 | Nunez | 70/283 |
| 6,895,791 | B2 * | 5/2005 | Alexander et al. | 70/277 |
| 7,007,526 | B2 * | 3/2006 | Frolov et al. | 70/277 |
| 7,096,698 | B2 * | 8/2006 | Walsh et al. | 70/472 |
| 7,188,495 | B2 * | 3/2007 | Errani et al. | 70/278.7 |

* cited by examiner

*Primary Examiner* — Christopher Boswell
*Assistant Examiner* — Eric Kurilla
(74) *Attorney, Agent, or Firm* — Alix, Yale & Ristas, LLP

(57) ABSTRACT

An electrically controlled door lock device with a lockset with an inside handle, an outside handle, a spring loaded continuous spindle, biased to maintained a lockset's latch in a projected position and connecting the lockset and the outside handle, a first half and a second half of a clutch connecting the continuous spindle and the inside handle with a spring maintaining the second half of the clutch in predetermined position relative to the first half of the clutch. There is also a mechanical means blocking the first half of the clutch from rotation and electromechanical means controlling the blocking means, the mechanical means built into the second half of the clutch, allowing the second half of the clutch a predetermined degree of free rotation before it engages with the first half of the clutch, the mechanical means built into second half of the clutch, mechanically inhibiting the blocking means.

20 Claims, 3 Drawing Sheets

ELECTRICALLY CONTROLLED DOOR LOCK

This application claims priority to U.S. Provisional Application 61/248,563 filed on Oct. 5, 2009, the entire disclosure of which is incorporated by reference.

TECHNICAL FIELD & BACKGROUND

The present invention generally relates to an improved door lock. More specifically, the invention is an improved electrically controlled door lock.

It is an object of the invention to provide an improved electronically controlled door lock that is more secure, vandal-proof and provides more protection by locating locking elements in the protected area.

It is it is another object of the invention to provide an improved electronically controlled lock, which can be unlocked from a protected side by a single handle motion.

It is another object of the invention to provide inexpensive electronically controlled lock.

BRIEF DESCRIPTION OF THE DRAWINGS

The present invention will be described by way of exemplary embodiments, but not limitations, illustrated in the accompanying drawings in which like references denote similar elements, and in which.

DETAILED DESCRIPTION OF ILLUSTRATIVE EMBODIMENTS

Various aspects of the illustrative embodiments will be described using terms commonly employed by those skilled in the art to convey the substance of their work to others skilled in the art. However, it will be apparent to those skilled in the art that the present invention may be practiced with only some of the described aspects. For purposes of explanation, specific numbers, materials and configurations are set forth in order to provide a thorough understanding of the illustrative embodiments. However, it will be apparent to one skilled in the art that the present invention may be practiced without the specific details. In other instances, well-known features are omitted or simplified in order not to obscure the illustrative embodiments.

Various operations will be described as multiple discrete operations, in turn, in a manner that is most helpful in understanding the present invention; however, the order of description should not be construed as to imply that these operations are necessarily order dependent. In particular, these operations need not be performed in the order of presentation.

The phrase "in one embodiment" is used repeatedly. The phrase generally does not refer to the same embodiment, however, it may. The terms "comprising", "having" and "including" are synonymous, unless the context dictates otherwise.

Figure 1A:
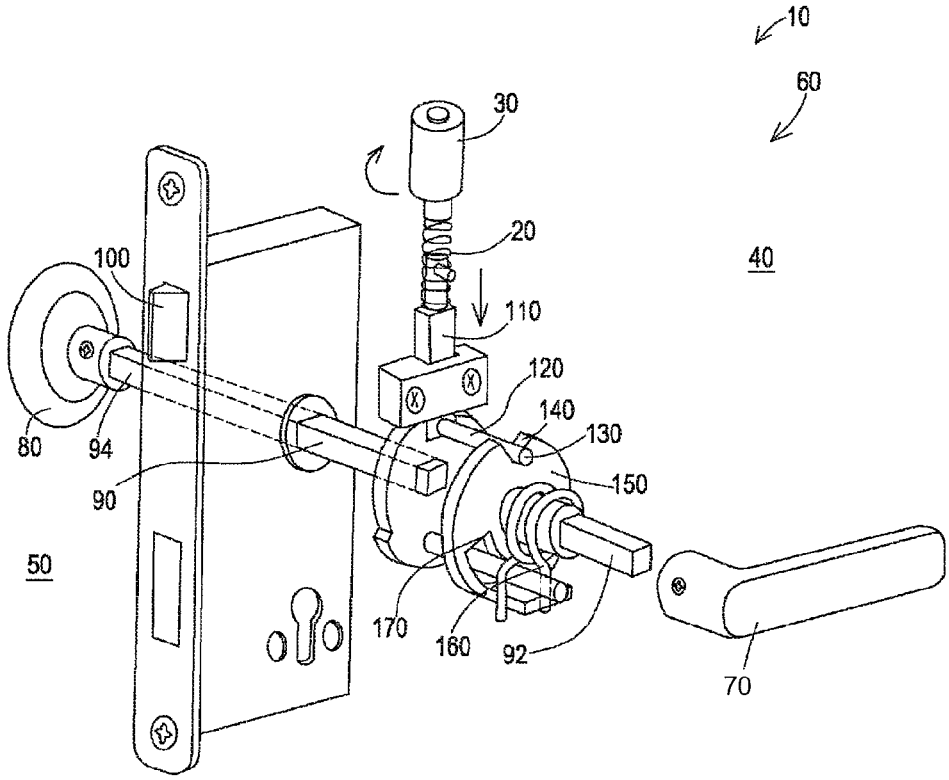
FIG. 1A illustrates a diagonal front side perspective view of an electrically controlled door lock in the static locked state, in accordance with one embodiment of the present invention.
Figure 1B:
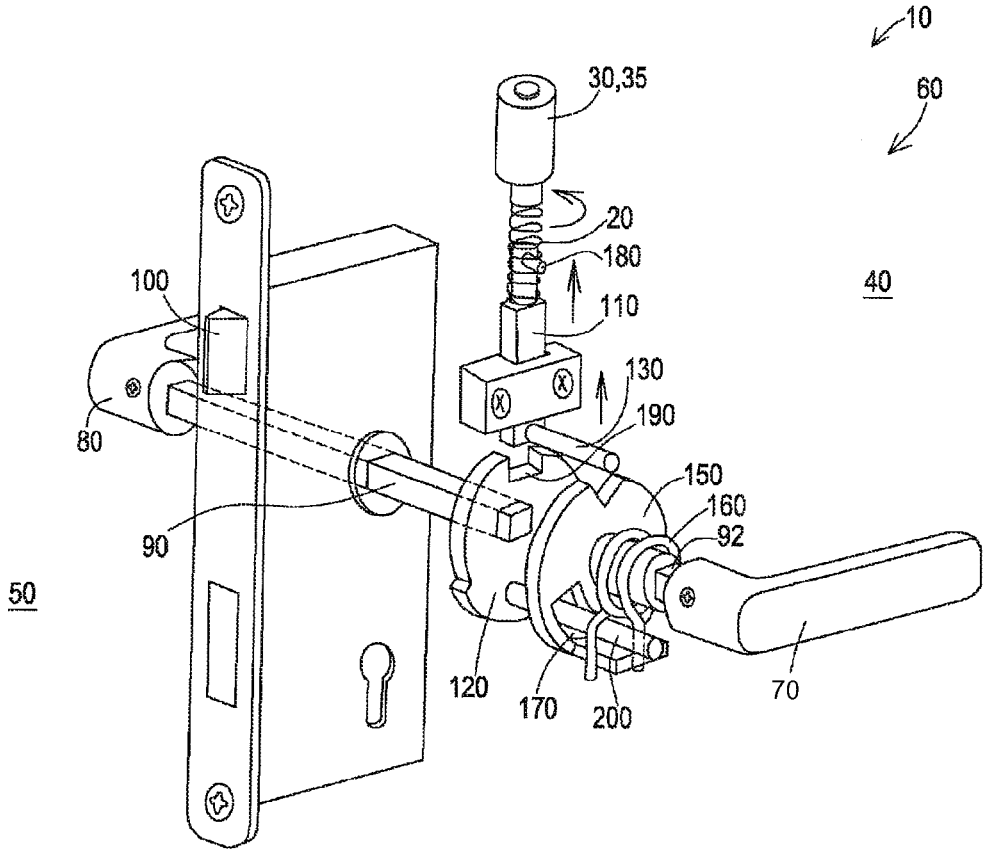
FIG. 1B illustrates a diagonal front side perspective view of an electrically controlled door lock in a mode being unlocked electronically, showing a rotational movement driven by a motor of a spring shaft around a drive pin, an upward simultaneous movement of a lifting pin and a locking pin, in accordance with one embodiment of the present invention.
Figure 1C:
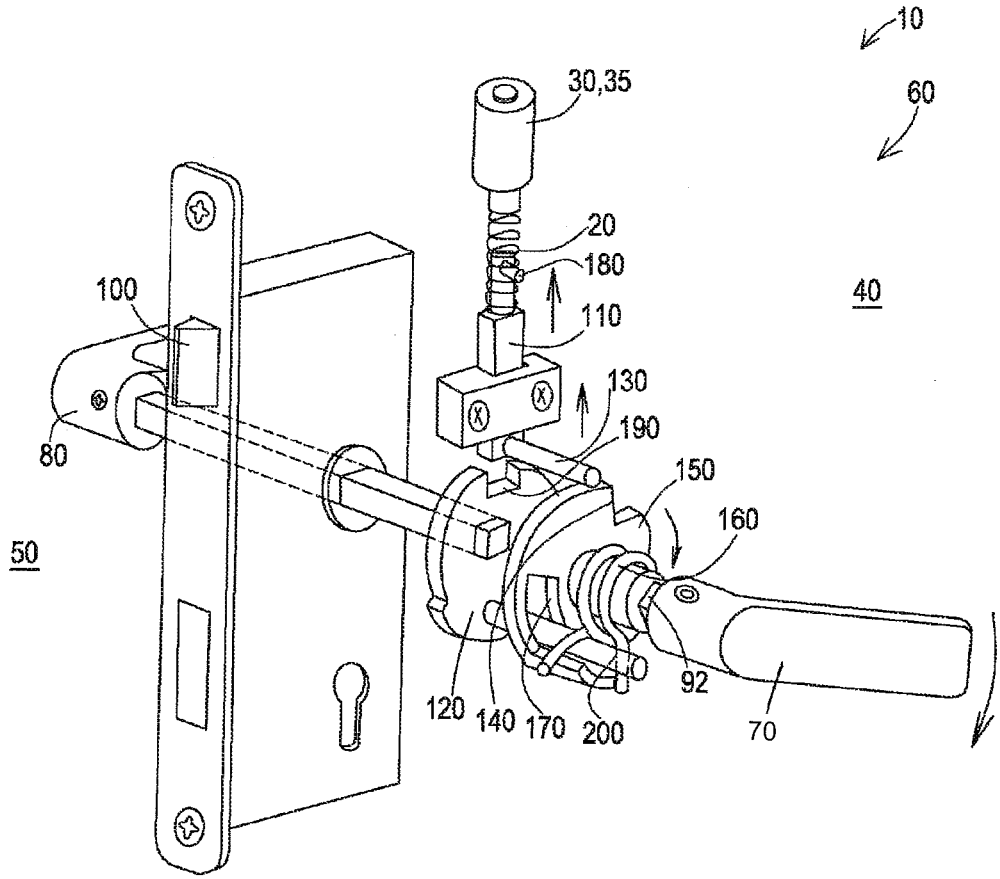
FIG. 1C illustrates a diagonal front side perspective view of an electrically controlled door lock in a mode being unlocked by one motion rotation of an inside handle, showing vertical compression of a spring shaft, an upward simultaneous movement of a lifting pin and a locking pin, being lifted by a cam built into a second half of a clutch rigidly attached to an inside handle, in accordance with one embodiment of the present invention.

FIG. 1A illustrates a diagonal front side perspective view of an electrically controlled door lock 10 in a locked static state, in accordance with one embodiment of the present invention. FIG. 1B illustrates a diagonal front side perspective view of an electrically controlled door lock 10 in a mode being unlocked by an electronic means, showing a rotational movement of a spring shaft 20 around a drive pin 180, inserted into a locking pin 110, an upward simultaneous movement of a lifting pin 130 and the locking pin 110 out of a locking slot 190 and a rotational movement of a motor 30, in accordance with one embodiment of the present invention. FIG. 1C illustrates a diagonal front side perspective view of an electrically controlled door lock 10 in a mode being unlocked manually from inside by a single rotation of an inside handle 70, showing vertical compression of a spring shaft 20, an upward simultaneous movement of a lifting pin 130 and a locking pin 110, being lifted by a cam 140 in a second half of a clutch 150, that is rigidly attached to an inside handle 70, in accordance with one embodiment of the present invention.

The electrically controlled door lock 10 is partially protruding inside of a protected area 40 and partially protruding outside of a protected area 50 with the inside protected area 40 separated by a door (not shown) from the outside protected area 50. The electrically controlled door lock 10 can be an electromechanical or electronic lock and has a lockset 60, an inside handle 70, an outside handle 80 and a continuous spindle 90 connecting the outside handle 80 and the lockset 60

The electrically controlled lock 10 also includes a clutch with a first half 120, attached to the continuous spindle 90 and a second half of the clutch 150, attached to the inside handle 70, a locking pin 110, a drive pin 180 and a lifting pin 130, both inserted into the locking pin 110, an electric motor 30 with an attached spring shaft 20 and torsion spring 160 disposed on the second half of the clutch 150. Also there is an arched slot 170 on the second half of the clutch 150 and an engaging pin 200 inserted into the first half of the clutch 120 and protruding through the arched slot 170. There is also a cam configured portion 140 of the second half of the clutch 150, which is engaged with the lifting pin 130.

FIGS. 1A, 1B and 1C illustrate the electrically controlled door lock 10 where the lockset 60 is of the European mortise type lock. However, the electrically controlled door lock 10 can be used with any type of lockset that is well known to those schooled in the art.

The inside handle 70 is free to move at all times. In a static locked mode illustrated in FIG. 1A, the outside handle 80 is rigid because of the locking pin 110 being engaged with the locking slot 190 in the first half of the clutch 120, thus preventing the interconnected parts, such as the continuous spindle 90, outside handle 80 and parts in the lockset 60 from rotating. In a lock mode being unlocked electronically, as illustrated in FIG. 1B, a signal from an electronic controller 35 starts for a predetermined time electric motor 30 which rotates the spring shaft 20 around the drive pin 180, which is inserted into the locking pin 110, grounded in a manner allowing only linear movement. The combination of the spring shaft 20 and the drive pin 110 acts like a screw-nut couple, with a correctly chosen direction of the motor rotation, the grounded rotating the spring shaft 20, acting like a screw, causes the drive pin 180, acting like a nut, to move upward, pulling the connected locking pin 130 out of engagement with the locking slot 190, thus freeing the outside handle 80 to operate the lockset 60.

Electronic locking the electrically controlled door lock 10 from the outside protected area 50 is accomplished by another signal from the controller 35, which starts the motor 30 again, but this time in an opposite direction, engaging the previously described locking elements again. In the lock mode being unlocked manually by the inside handle 70, the inside handle's 70 motion is initially limited by the arched slot 170 and the engaging pin 200, which is a part of the first half 120 of the clutch, locked at this moment. During this limited motion, the torsion spring 160 gets slightly compressed. Also in this period of time, the cam 140 on the second half 150 of the clutch pushes the lifting pin 130 upward simultaneously with the locking pin 130 and the drive pin 180 and at the same time compresses the upper portion of the spring shaft 20. The parts involved are designed in such way, that when the end of the arched slot 170 and engaging pin 200 get in contact, the locking pin 130 is already out of engagement with the locking slot 190. (Note that after the clutch is engaged, the torsion spring 160 is not being compressed any further, thus adding relatively low extra resistance to the resistance of the torsion spring 160 and the spring shaft 20 inside the lockset 60.) At this moment the user would continue rotating the engaged clutch, not noticing any interruption in the motion and eventually retracting the latch 100. After the user's egress is completed and the door is closed, the continuous spindle 90 and all the associated parts are forced back into their initial position by the lockset's 60 internal springs (not shown). In this initial position, the compressed upper portion of the spring shaft 20 forces the locking pin 130 back into the locking slot 190, thus completing automatic relocking.

While the present invention has been related in terms of the foregoing embodiments, those skilled in the art will recognize that the invention is not limited to the embodiments described. The present invention can be practiced with modification and alteration within the spirit and scope of the appended claims. Thus, the description is to be regarded as illustrative instead of restrictive on the present invention.

What is claimed is:

1. An electrically controlled door lock device, comprising:

a lockset with an inside handle, an outside handle, a spring loaded continuous spindle defining a spindle axis disposed in a central plane and biased to maintain a lockset's latch in projected position and connecting said lockset and said outside handle;

a first half and a second half of a clutch connecting said continuous spindle and said inside handle;

a spring maintaining said second half of said clutch in predetermined position relative to said first half of said clutch; and a mechanical means blocking said first half of said clutch and an electromechanical means controlling a blocking means, said blocking means disposed on one side of said plane and being displaceable on a blocking axis perpendicular to and intersecting said spindle axis, said mechanical means disposed on said second half of said clutch, allowing said second half of said clutch some predetermined degree of free rotation before it engages with said first half of said clutch, said mechanical means built into second half of said clutch, mechanically inhibiting said blocking means, overriding said electromechanical means while said second half is freely rotating.

2. The device according to claim 1, wherein said spring maintaining said second half of said clutch in predetermined position relative to said first half of said clutch is grounded to said first half of said clutch, thus providing low operating torque when said halves are engaged and operate against said spring loaded continuous spindle.

3. The device according to claim 1, wherein said mechanical means is a cam, an arched slot, an engaging pin and said spring.

4. The device according to claim 1, wherein said electromechanical means is an electromechanical motor.

5. The device according to claim 4, wherein said electromechanical motor is controlled by a controller.

6. The device according to claim 4, wherein said electromechanical motor is controlled by a controller.

7. The device according to claim 1, wherein said blocking means is a spring shaft, a drive pin, a locking pin and a lifting pin.

8. The device according to claim 1, wherein said inside handle is free to move at all times.

9. The device according to claim 1, wherein said spring maintaining said second half of said clutch in predetermined position relative to said first half of said clutch is grounded to said first half of said clutch, thus providing low operating torque when said halves are engaged and operate against said spring loaded continuous spindle.

10. The device according to claim 1, wherein said mechanical means is a cam, an arched slot, an engaging pin and said spring.

11. The device according to claim 1, wherein said electromechanical means is an electromechanical motor.

12. The device according to claim 1, wherein said inside handle is free to move at all times.

13. A lockset for an electrically controlled door lock, comprising:

an inside handle, an outside handle, a spring loaded continuous spindle defining a spindle axis disposed in a central plane biased to maintain a lockset's latch in projected position and connecting said lockset and said outside handle;

a first half and a second half of a clutch connecting said continuous spindle and said inside handle;

a spring maintaining said second half of said clutch in predetermined position relative to said first half of said clutch; and a mechanical means blocking said first half of said clutch from rotation and electromechanical means controlling a blocking means, said blocking means disposed on one side of said plane and being displaceable on a blocking axis perpendicular to and intersecting said spindle axis, said mechanical means built into said second half of said clutch, allowing said second half of said clutch some predetermined degree of free rotation before it engages with said first half of said clutch, said mechanical means built into second half of said clutch, mechanically inhibiting said blocking means overriding said electromechanical controls while said second half is freely rotating.

14. The lockset according to claim 11, wherein said spring maintaining said second half of said clutch in predetermined position relative to said first half of said clutch is grounded to said first half of said clutch, thus providing low operating torque when said halves are engaged and operate against said spring loaded continuous spindle.

15. The lockset according to claim 13, wherein said mechanical means is a cam, an arched slot, an engaging pin and said torsion spring.

16. The lockset according to claim 13, wherein said electromechanical means is an electromechanical motor.

17. The lockset according to claim 16, wherein said electromechanical motor is controlled by a controller.

18. The lockset according to claim 13, wherein said blocking means is a spring shaft, a drive pin, a locking pin and a lifting pin.

19. The lockset according to claim 13, wherein said inside handle is free to move at all times.

20. An electrically controlled door lock device, comprising:

a lockset with an inside handle, an outside handle, and a spring loaded continuous spindle defining a spindle axis and biased to maintain a lockset's latch in projected position and connecting said lockset and said outside handle;

a first half and a second half of a clutch connecting said continuous spindle and said inside handle;

a spring maintaining said second half of said clutch in predetermined position relative to said first half of said clutch; and a mechanical means blocking said first half of said clutch and an electromechanical means controlling a blocking means, said blocking means comprising a rotatable spring shaft having a plurality of helical coils defining a central spring axis perpendicular to said spindle axis and intersecting said spindle axis and a drive pin engageable with said spring shaft and slidable along said coils for linear movement along said spring axis, said mechanical means disposed on said second half of said clutch, allowing said second half of said clutch some predetermined degree of free rotation before it engages with said first half of said clutch, said mechanical means built into second half of said clutch, mechanically inhibiting said blocking means, overriding said electromechanical means while said second half is freely rotating.

* * * * *